United States Patent [19]

Sobeck et al.

[11] Patent Number: 4,902,050

[45] Date of Patent: Feb. 20, 1990

[54] KNOT TYING DEVICE

[75] Inventors: Eugene E. Sobeck, Minnesota City; Edward L. Steele, Winona, both of Minn.

[73] Assignee: Lake Center Industries a division of Guy F. Atkinson Company, South San Francisco, Calif.

[21] Appl. No.: 232,142

[22] Filed: Aug. 15, 1988

[51] Int. Cl.[4] ..... B65H 69/04

[52] U.S. Cl. ..... 289/1.5

[58] Field of Search ..... 289/1.5, 5, 6, 7, 12, 289/13

[56] References Cited

U.S. PATENT DOCUMENTS

| | | | |
|---|---|---|---|
| 352,602 | 11/1886 | Appleby | 289/6 |
| 617,545 | 1/1899 | Steward | 289/5 |
| 629,871 | 8/1899 | Postley | 289/12 |
| 1,099,128 | 6/1914 | Poege, Jr. | 289/12 |
| 1,170,885 | 2/1916 | Enslin | 289/7 |
| 3,752,517 | 8/1973 | Warmack | 289/17 |
| 3,940,169 | 2/1976 | Kock | 289/1.5 |
| 4,146,255 | 3/1979 | Nohrenberg et al. | 289/15 |

*Primary Examiner*—Werner H. Schroeder
*Assistant Examiner*—D. Price
*Attorney, Agent, or Firm*—Kinzer, Plyer, Dorn, McEachran & Jambor

[57] ABSTRACT

A method and apparatus is disclosed for the tying of knots in elongated flexible members such as string or rope. The method includes the steps of first providing an elongated member of a desired length and then clamping the elongated member at a location spaced a predetermined distance from the free end thereof while rotating the clamped location to form a loop, with the free end crossing over the loop. The free end of the elongated member is then removed through the loop and the end is then clamped. The initial clamping pressure is released and the elongated member is then pulled to complete the tying of a knot.

10 Claims, 3 Drawing Sheets

Fig. 3.
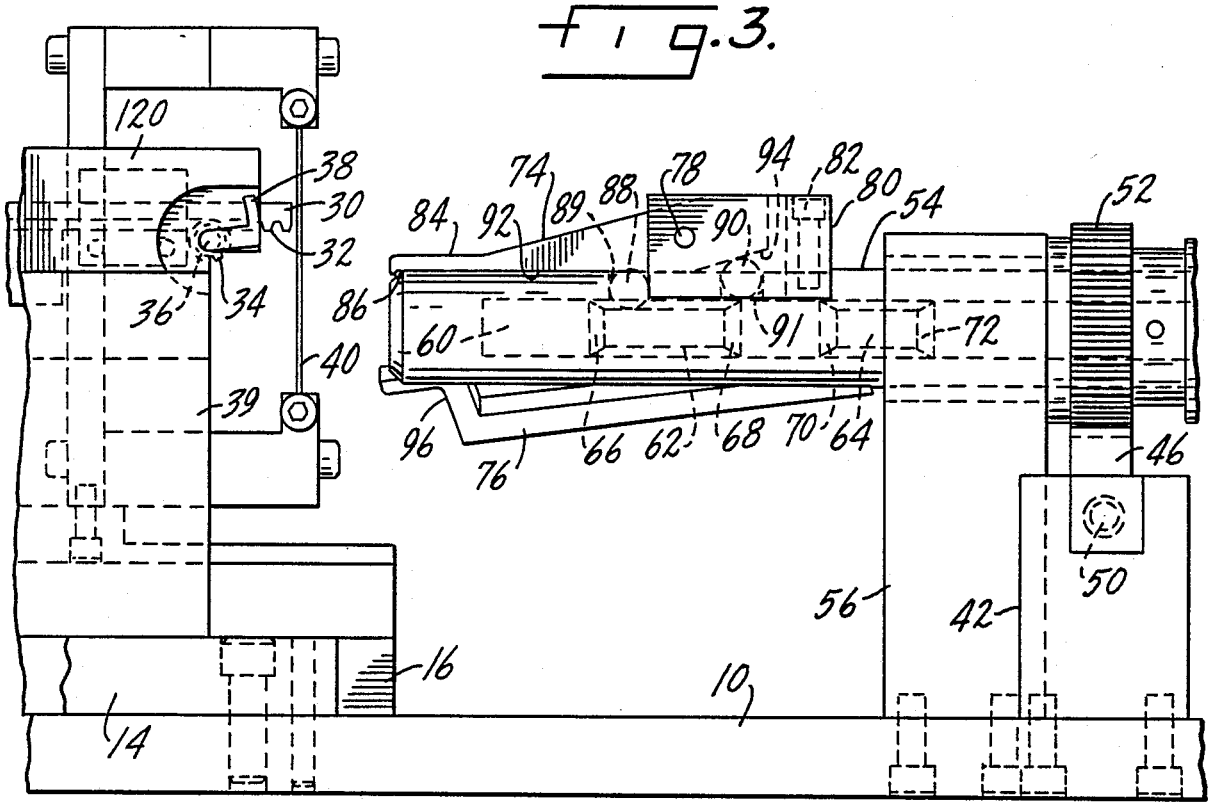
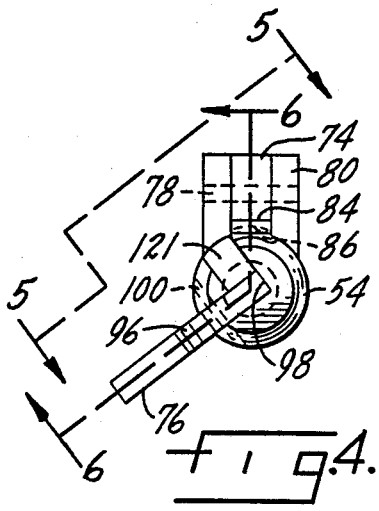
Fig. 4.
Fig. 5.
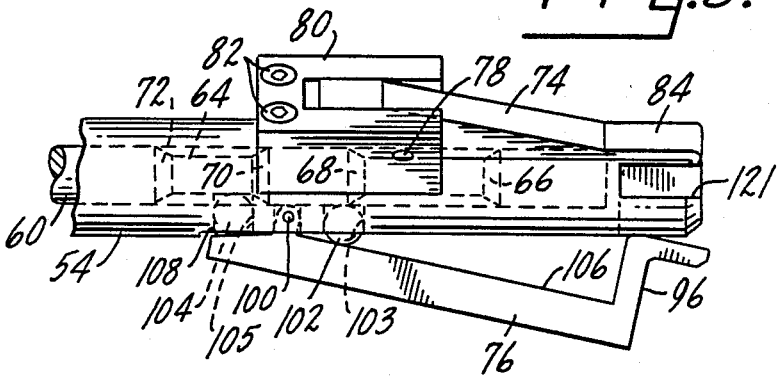
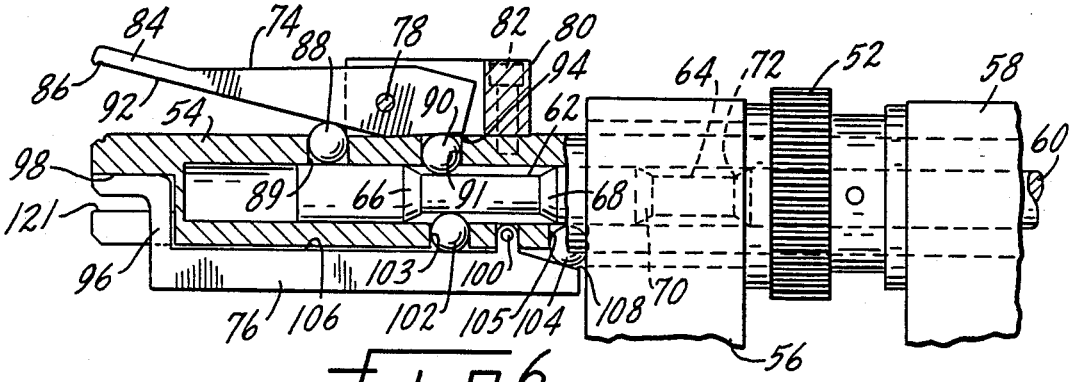
Fig. 6.

KNOT TYING DEVICE

SUMMARY OF THE INVENTION

The present invention relates to a knot tying apparatus and to a method of tying a knot in an elongated flexible member such as a string or rope or cord and has particular relation to such a device which reliably and automatically insures that a knot is tied at a predetermined distance from the end of the member.

A primary purpose of the invention is a knot tying method and apparatus which has application to such as window cords, drapery pulls, venetian blind cords, the starter ropes for gasoline engines as used in outboard motors, lawn mowers, snow blowers and the like.

Another purpose is a simply constructed, reliably operable knot tying mechanism which insures accurately positioned knots in an elongated member such as a cord or the like.

Other purposes will appear in the ensuing specification, drawings and claims.

BRIEF DESCRIPTION OF THE DRAWINGS

The invention is illustrated diagrammatically in the following drawings wherein:

FIG. 3 is an enlarged partial side view of the apparatus in FIG. 1 in an initial or start position, FIG. 4 is an end view of the clamp shaft of the apparatus of FIG. 3, FIG. 5 is a view along plane 5—5 of FIG. 4, FIG. 6 is a section along plane 6—6 of FIG. 4.

DESCRIPTION OF THE PREFERRED EMBODIMENT

Figure 1:
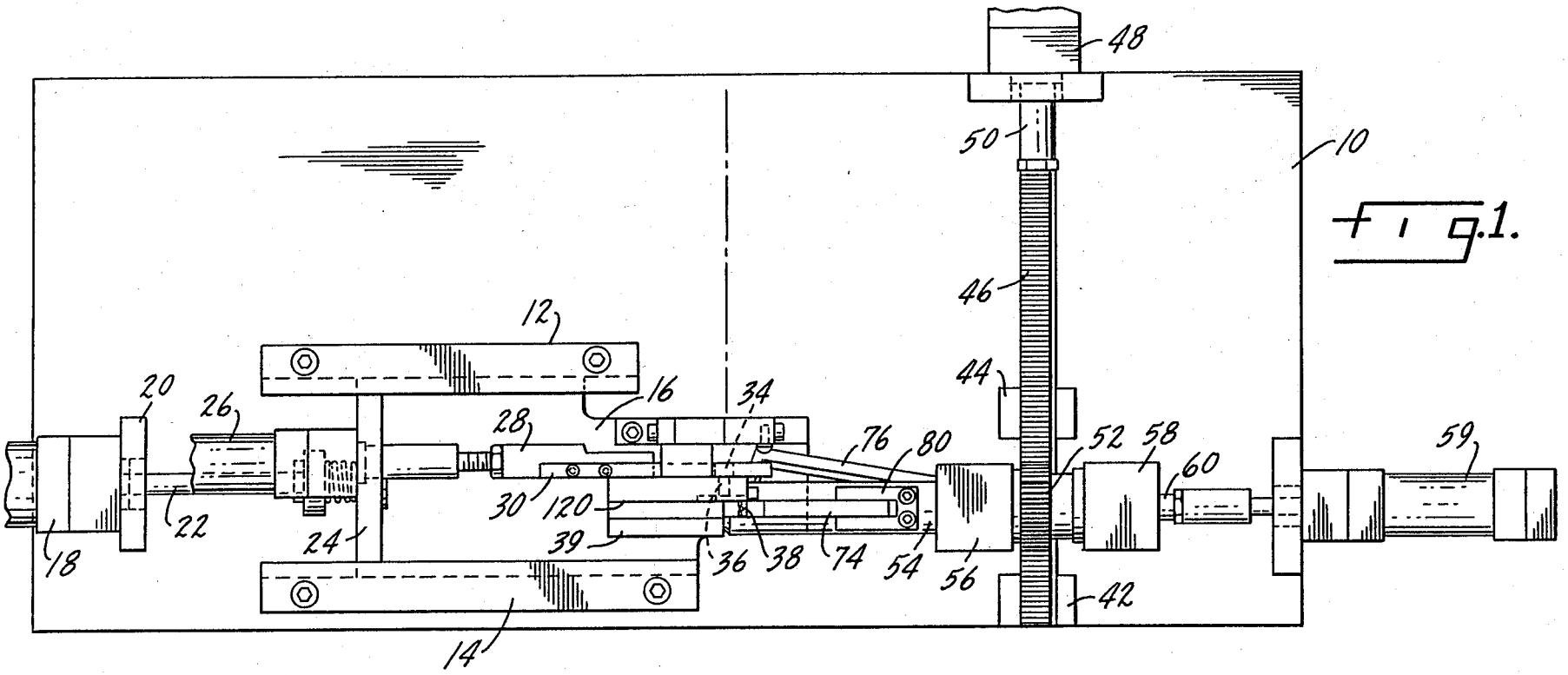
FIG. 1 is a top plan view of the knot tying apparatus of the present invention.
Figure 2:
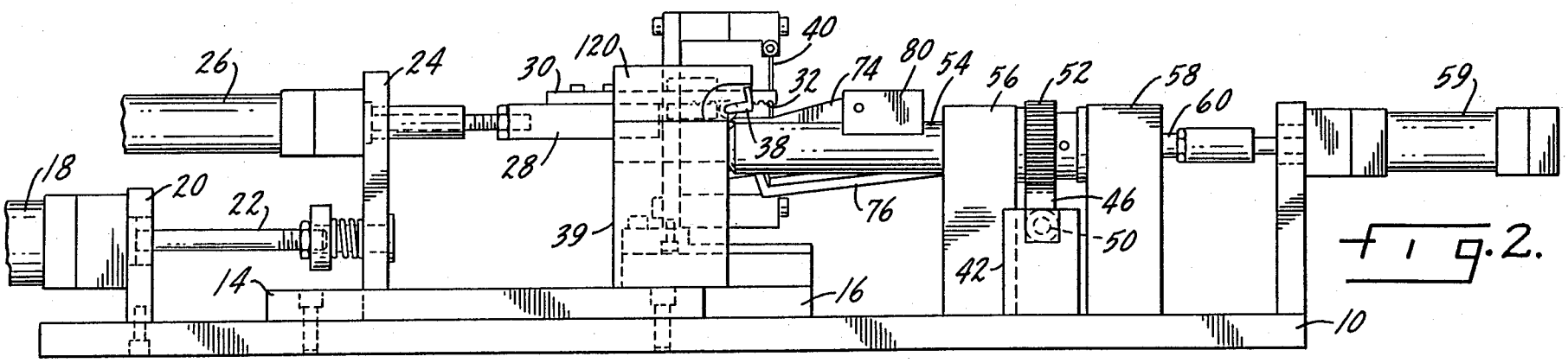
FIG. 2 is a side view of the apparatus shown in FIG. 1.
Figure 7:
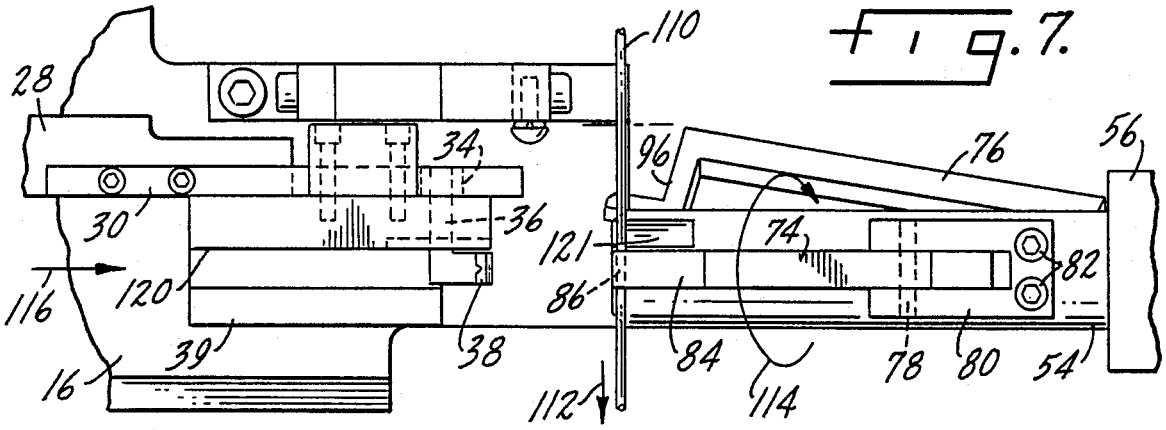
FIG. 7 is an enlarged partial top view showing the knot tying apparatus in the start position of FIG. 3.

The apparatus is indicated generally in the top and side views of FIGS. 1 and 2 wherein a base or platform is indicated at 10. Shuttle gibs 12 and 14 mount a shuttle 16. The shuttle is moved back and forth within the way provided by the gibs by means of an air cylinder 18 which is mounted on a support 20 fastened to the base 10. A rod 22 extends outwardly from the air cylinder and is connected to a support 24 mounted on shuttle 16, which support in turn mounts a second air cylinder 26 having a reciprocal output rod 28. Rod 28 is attached to a rack 30 having a downwardly-facing toothed surface 32 illustrated in more detail in FIG. 3. Rack 32 is in mesh with a gear 34 mounted on one end of a shaft 36 with the other end of the shaft mounting a hook 38 to the end that reciprocal movement of rack 30 will cause rotary movement of hook 38. Shaft 36 is mounted in a support member 39.

Also mounted on shuttle 16 is a cut-off device in the form of a hot wire 40 which is used to sever the cord or string, depending upon the application, into predetermined lengths. Movement of the shuttle 16 is effective to move the hot wire toward and away from the cut-off position.

Base 10 also mounts a pair of support elements 42 and 44 which mount and position a rack 46 reciprocally moved by an air cylinder 48 having an output rod 50. Rack 46 is in mesh with a gear 52 which is fast on a clamp shaft 54. Reciprocal movement of the rack is effective to turn gear 52 and thus rotate shaft 54. Clamp shaft 54 is supported in bearing structures 56 and 58 mounted on base 10.

As illustrated in FIGS. 3–6, clamp shaft 54 has an internal piston 60 movable by an air cylinder 59. Piston 60 has a pair of spaced relieved areas 62 and 64 which together define four cam surfaces indicated at 66, 68, 70 and 72. There are a pair of clamps 74 and 76 mounted on clamp shaft 54 for use in clamping the cord during the time it is formed into a loop and during the time the cord is pulled tight to form the loop into a knot. Clamp 74, which is mounted on the top of shaft 54 in the release position is pivoted, as at 78, within a bracket 80 mounted to the clamp shaft by screws 82. Clamp 74 has a nose 84 with a small slot 86, best shown in FIG. 6. There are a pair of balls 88 and 90 positioned in shaft slots 89 and 91 which cooperate with cam surfaces 66 and 68 on piston 60 to cause the clamp 74 to move from the closed or operated position of FIG. 3 to the open position of FIG. 6. Ball 88 cooperates with a lower flat surface 92 on clamp 74 and ball 90 cooperates with a slanted surface 94 on the bottom of clamp 74, as particularly shown in FIG. 3. Clamp 76 has a hook-shaped nose 96 which fits within a slot 98 in clamp shaft 54, as particularly shown in FIG. 6. Clamp 76 is pivoted to the clamp shaft, as at 100, and has a pair of balls 102 and 104 positioned in shaft slots 103 and 105 which cooperate with cam surfaces 68 and 70 to effect movement of clamp 76 between the closed position of FIG. 6 and the open position of FIG. 5. Ball 102 cooperates with surface 106 of clamp member 76 and ball 104 cooperates with slanted surface 108 of clamp 76.

The invention is designed to tie knots in what has been termed "elongated members" such as cord, string or rope. For purposes of illustration, the invention will be described in connection with cord of the type used on drapery pulls. The cord may be fed from a continuous reel (not shown) and there will be a device which will pull the cord from the reel through the mechanism shown herein. Turning particularly to FIGS. 7–11, cord 110 will be pulled from a suitable source, whether it be a reel or otherwise, in the direction of arrow 112 and the amount of cord that is pulled will be predetermined and when the desired length has been reached, the cord pulling mechanism will stop. Note that the cord is positioned within the small groove 86 in clamp 74. After the predetermined length of cord has been pulled, the first step in the knot tying procedure is the clamp shaft 54 will have clamp 74 closed and clamp 76 open and piston 60 will be in the position illustrated in FIG. 3. Cord 110 will be held by clamp 74 a predetermined distance from its end. The air cylinder 18 will move shuttle 16 to the right so that hot wire 40 carried by and movable with shuttle 16 will sever cord 110.

Figure 8:
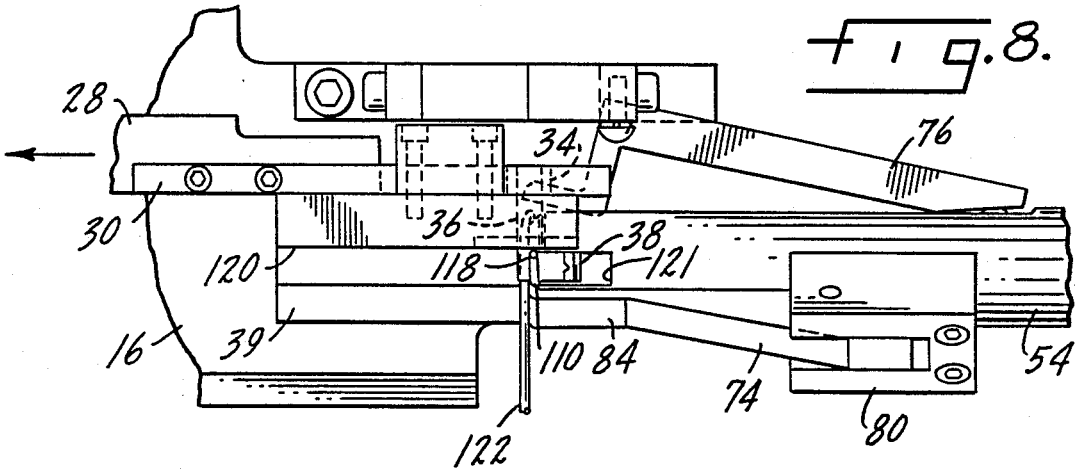
FIG. 8 is a top view, similar to FIG. 7, but with the apparatus moved to a position in which the cord has been severed and wound into a loop.

Air cylinder 48 will now move rack 46, causing gear 52 to turn, resulting in the rotation of clamp shaft 54 in the direction shown by arrow 114. The clamp shaft will turn through approximately 270 degrees until the cord 110 has formed a loop, as illustrated in FIG. 8. When the apparatus is in the position of FIG. 7, the hot wire has not been moved to the cut-off position, but it will be moved toward the cut-off position in the direction of arrow 116. The position of the wire after cut-off, is illustrated in FIG. 8.

As clamp shaft 54 turns in the direction of arrow 114, cord 110 will form a loop, as shown in FIG. 8, and the free end 118 of the loop will be pressed against a deflector surface 120 formed on support 39. The deflector surface will cause the free end 118 to extend upwardly and be positioned adjacent hook 38.

Figure 9:
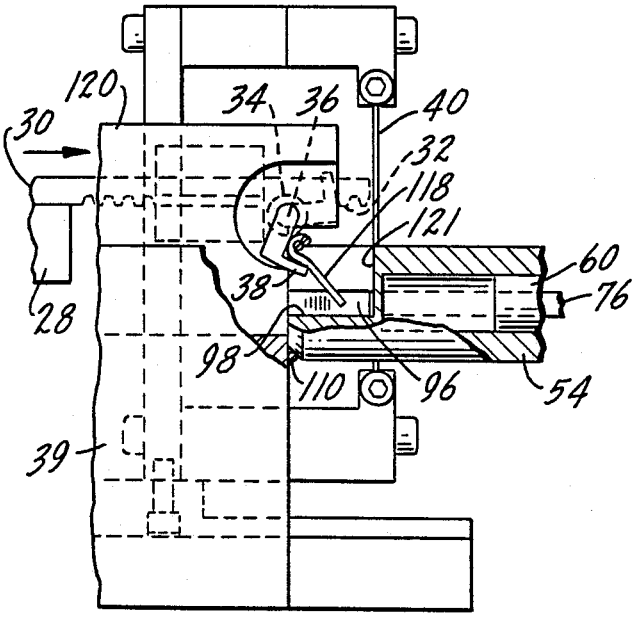
FIG. 9 is a side view, on the same scale as in FIG. 3, but with the cord moved to partially form the knot loop.

Air cylinder 26 will now cause movement of rack 30 and through gear 34 turn shaft 36. This will result in a rotation of hook 38 and the hook will catch and then rotate the free end 118 of the cord, as illustrated in FIG. 9, and the free end will be rotated in a counterclockwise direction until it extends within upwardly-facing slot 121 in clamp shaft 54. In the position of FIG. 9, the free end of the cord is within slot 121 and has been so positioned by rotation of the hook.

Figure 10:
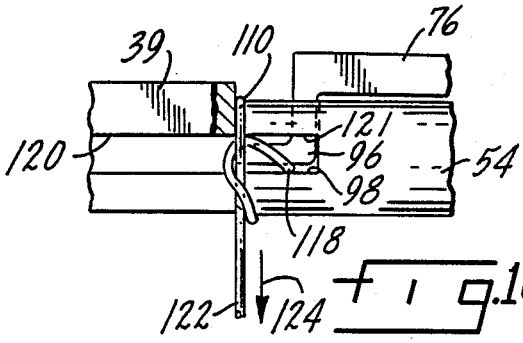
FIG. 10 is a top view, on the same scale as FIGS. 7, 8 and 9, but showing the loop fully made and the end clamped.
Figure 11:
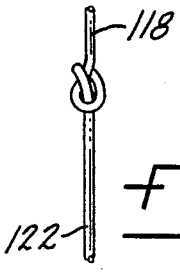
FIG. 11 is a top view of a completed knot.

Air cylinder 59, which is attached to and effective to cause movement of piston 60, will now draw the piston toward the right, away from the start position of FIG. 3 toward the fully operated position of FIG. 6. As the piston so moves, the balls 88, 90 and 102,104 will cooperate with the mating surfaces on clamps 74 and 76 to release clamp 74 and operate clamp 76 so that its nose 96 clamps the end 118 of cord 110 within slot 121. As can be seen from FIGS. 3 and 6, as piston 60 moves to the right, there will be a small degree of overlap for the operation of the two clamps. In effect, the operated clamp does not fully release until the release clamp has been at least partially operated. Thus, clamp 76 will have clamped on the end 118 of cord 110 just slightly prior to the full release of clamp 74. Once clamp 76 has fully engaged the end 118 of the cord, pulling pressure will be applied to the end 122 of the cord in the direction of arrow 124, as shown in FIG. 10. This pressure will be sufficient to pull the cord between the adjacent ends of clamp shaft 54 and support 39. The force applied in the direction of arrow 124 will first draw the cord between these elements as described and then complete the knot. Air cylinder 59 will then move piston 60 back toward the left so as to release clamp 76 and operate clamp 74. The release of clamp 76 allows the completed knot to be pulled out of the apparatus and the operation of clamp 74 is necessary for the next knot tying operation. As this happens, air cylinder 18 will move the shuttle 16 toward the left, returning the shuttle to the full release position and in a position to be ready for the next knot tying operation.

Whereas the preferred form of the invention has been shown and described herein, it should be realized that there may be many modifications, substitutions and alterations thereto.

The embodiments of the invention in which an exclusive property or privilege is claimed are defined as follows:

1. A method of tying a knot in an elongated flexible member such as a string or rope including the steps of:

(1) providing an elongated flexible member of a desired length, (2) clamping the elongated flexible member at a location spaced a predetermined distance from an end thereof while rotating the clamped location to form a loop with the end thereof crossing over the loop, (3) moving the elongated flexible member end through the loop and clamping the end thereof after it has moved through the loop, and (4) releasing the clamping pressure applied at the spaced location on the elongated flexible member and pulling the elongated flexible member away from the loop while maintaining clamping pressure on the clamped end thereof to form a knot.

2. The method of claim 1 further characterized in that an elongated flexible member of a desired length is provided by severing a generally continuous elongated flexible member.

3. The method of claim 1 further characterized in that the end of the elongated flexible member is moved by catching it adjacent its end and then rotating the catched end in a plane generally perpendicular to the plane of the loop of the elongated flexible member.

4. The method of claim 3 further characterized in that the elongated flexible member's end is deflected so that it may be caught adjacent its end.

5. A mechanism for tying a knot in an elongated flexible member such as a rope or string including a support base, a rotatable member on said support base and having first clamp means thereon whereby the elongated flexible member may be clamped to the rotating member as it turns to form a loop in the elongated flexible member, means on said support base positioned adjacent said rotatable member for catching an end of the elongated flexible member and causing it to cross over the loop and then pass within the loop, second clamp means on said rotatable member for clamping said elongated flexible member's end after it has passed through the loop, means on said rotatable member for causing actuation and release of said first and second clamp means whereby after said second clamp means has been actuated, said first clamp means is released to permit pulling pressure on said elongated flexible member to pull against the clamped end to form a knot.

6. The mechanism of claim 5 further characterized by and including means for severing said elongated flexible member into predetermined lengths.

7. The mechanism of claim 6 further characterized in that the means for severing said elongated flexible member into predetermined lengths includes a hot wire, and means for reciprocally moving said hot wire back and forth across the path of movement of said elongated flexible member.

8. The mechanism of claim 5 further characterized by and including a shuttle movable on said support base toward and away from said rotatable member, the means for catching an end of said elongated member including a hook mounted for rotational movement on said shuttle.

9. The mechanism of claim 8 further characterized by and including deflector means mounted on said shuttle adjacent the path of movement of said hook to deflect the end of the elongated flexible member into the hook.

10. The mechanism of the claim 9 further characterized by and including means for severing the elongated flexible member into predetermined lengths mounted on and movable with said shuttle.

* * * * *